US006070048A

United States Patent [19]

Nonaka et al.

[11] Patent Number: 6,070,048

[45] Date of Patent: May 30, 2000

[54] PAPER WIDTH DETECTING DEVICE

[75] Inventors: Ken Nonaka; Tadayoshi Ikeda, both of Hachioji, Japan

[73] Assignee: Konica Corporation, Tokyo, Japan

[21] Appl. No.: 09/178,946

[22] Filed: Oct. 26, 1998

[30] Foreign Application Priority Data

Oct. 29, 1997 [JP] Japan ..... 9-297240

[51] Int. Cl.[7] ..... G03G 15/00

[52] U.S. Cl. ..... 399/376; 399/389

[58] Field of Search ..... 399/376, 389

[56] References Cited

U.S. PATENT DOCUMENTS 5,826,156 10/1998 Natsume et al. ..... 399/389

5,875,033 2/1999 Kawata et al. ..... 358/296

*Primary Examiner*—William Royer

*Assistant Examiner*—Greg Moldafsky

*Attorney, Agent, or Firm*—Frishauf, Holtz, Goodman, Langer & Chick, P.C.

[57] ABSTRACT

A device for detecting a width of a sheet placed on a manual feeding tray of an image forming apparatus includes a first and a second sheet regulating member for moving in a sheet width direction so as to come in contact with both sides of the sheet and for holding the sheet therebetween, thereby regulating movement of the sheet in the sheet width direction. A first rack member, on which a first rack is arranged in the sheet width direction, moves interlockingly with the first sheet regulating member. A second rack member, on which a second rack and a sheet width-detecting rack are respectively arranged in the sheet width direction, moves interlockingly with the second sheet regulating member. The second rack is positioned so as to face the first rack on the first rack member, and a pinion engages with the first rack and the second rack. A gear engages with the sheet width-detecting rack, and a rotary variable resistor is provided which has a shaft which is coaxially joined to the gear so as to regulate rotational displacement of the rotary variable resistor relative to the gear. The rotary variable resistor is rotated when at least one of the first and the second sheet regulating members is moved so as to hold the sheet therebetween, and the rotary variable resistor has a resistance value which is varied in accordance with a rotation angle thereof. A detector is provided for detecting the width of the sheet based on the resistance value of the rotary variable resistor.

7 Claims, 10 Drawing Sheets

PAPER WIDTH DETECTING DEVICE

BACKGROUND OF THE INVENTION

This invention relates to a paper width detecting device in a manual paper feeding tray on which a paper sheet to be fed to the mainframe of an image forming apparatus is placed.

In an image forming apparatus such as a copying machine and a printer, it is common practice to form an image on a paper sheet of various sizes. For example, in a copying machine, it is common a practice to make a copy of an original image on a transfer paper sheet of a size (A3, A4, B4, B5, etc) selected in accordance with the size of the original (A3, A4, B4, B5, etc) and the copy magnification. In this case, if the copying machine has a structure such that paper feeding cassettes of the number of kinds of paper sizes can be mounted to the apparatus mainframe, copying can be made by selecting the transfer paper of the desired size from the group of the paper feeding cassettes.

On the other hand, in a copying machine having only a limited small number of paper feeding cassettes mounted at a time, all of the papers of the desired sizes can not be selected from the group of the paper feeding cassettes. Therefore, some copying machines have a structure such that the transfer papers of the remaining sizes, which are not received in the group of the paper feeding cassettes, can be fed manually to the apparatus mainframe. In these copying machines, a manual paper feeding tray is mounted to the apparatus mainframe and the transfer papers of the remaining plural number of copy sizes are to be fed to the apparatus mainframe from this manual paper feeding tray. In this case, it is necessary for the control portion of the apparatus mainframe to be informed from the portion of the manual paper feeding tray as to which size transfer paper is set on the manual paper feeding tray so that the control portion of the apparatus mainframe may not select a wrong-sized paper.

For this reason, a mechanism for detecting the size of the placed paper is built in the manual paper feeding tray. Incidentally, paper size detection is made by detecting that the paper is of A-size, for example, from the detected value (measured value) of the width of the paper sheet placed on the tray, and further, by detecting whether it is an A3 paper placed longitudinally or an A4 paper placed transversely from the presence or absence of the placed paper at a predetermined position in the rear end side. In this case, the detection whether the placed paper sheet is present or not at the predetermined position in the rear end side is made easily by disposing a reflecting type sensor or the like at the predetermined position, however, it is not easy to detect the paper width precisely.

The conventional paper-width detecting device in the manual paper feeding tray also employs a first paper regulating member (a guide) and a second paper regulating member which are in contact with the placed paper sheet sidewise in the paper width direction in such a manner as to hold the paper sheet in between. An example of such a conventional paper-width detecting device employs a variable resistor of linear sliding type. That is, such a conventional device is provided with a linear resistor which has a fixed contact at one end and extends in the paper width direction, and is also provided with a moving contact which is in sliding contact with the linear resistor and is fixed on the first or the second paper regulating member for measuring the variation of the resistance between the fixed contact and the moving contact, so that it can detect the paper width by detecting the position of the paper regulating member.

However, this structure has a problem in that the area of the resistor is made large.

This problem can be solved by employing a rotary variable resistor. For example, the paper width detector may be provided with a pair of pulleys disposed at the positions apart from each other in the direction of the paper width to which a wire is entrained, with a part of the wire wound around the shaft of the rotary variable resistor, and detects the paper width by detecting the position of the paper regulating member from the rotation of the rotary variable resistor in accordance with the movement of the paper regulating member to which the wire is fixed.

Although the above-mentioned structure employing a wire has put the small sized resistor into use, it has a problem in that the accuracy of detecting the position of the paper regulating member is made low due to the slippage between the wire and the shaft of the rotary variable resistor, resulting in the lowered accuracy of the paper width detection.

Further, mounting the rotary variable resistor to the manual paper feeding tray is conventionally achieved by soldering the terminals (leads) of the rotary variable resistor to the printed board and then fixing this printed board at the predetermined position on the base plate of the manual paper feeding tray. However, due to the dispersion of the soldering position of the rotary variable resistor to the printed board, there has been a problem in that the terminals of the rotary variable resistor are deformed or damaged by an excessive load applied from the wire when the printed board is fixed.

SUMMARY OF THE INVENTION

This invention was made in view of the above mentioned problems, and its first object is to realize a paper width detecting device for a manual paper feeding tray which has a high detecting accuracy and which utilizes a small-sized rotary variable resistor. The second object is to realize a paper width detecting device for the manual paper feeding tray wherein the terminals of the rotary variable resistor are never deformed or damaged at the time of fixing the rotary variable resistor.

1. A paper width detecting device for the paper sheet placed on a manual paper-feeding tray on which a paper sheet to be fed to the mainframe of an image forming apparatus is placed, having a first and a second paper regulating member being in contact with the paper sheet sidewise in the paper width direction in such a manner as to hold the paper sheet in between for regulating the movement of the placed paper sheet in the direction of paper width, a first rack member, on which a first rack is formed in the paper width direction, moving unitedly together with said first paper regulating member, a second rack member, on which a second rack facing the first rack on said first rack member with a certain spacing to it and a rack for detecting paper width are formed in the paper width direction, moving unitedly together with said second paper regulating member, a pinion for transmitting motion engaging with said first and second rack, a gear for detecting paper width engaging with said rack for detecting paper width, and a rotary variable resistor having a resistance value varying in accordance with the angle of rotation of its shaft, and detecting paper width on the basis of the resistance value outputted from said rotary variable resistor.

In this invention, a paper sheet is placed on the manual paper feeding tray, and it is held between the first and second paper regulating member in the direction of paper width. On this occasion, the first and second rack members also move as a joined member but, owing to the engaging of the first and second rack with the pinion, the first and second paper regulating member move to the same distance in the reverse direction to each other. Accordingly, the central position of the placed paper sheet in the paper width direction is always constant regardless of the paper size.

When the second rack member moves, the gear for detecting paper width engaging with the rack for detecting paper width rotates, and the shaft of the rotary variable resistor also rotates. Thus, in accordance with the angle of rotation of this shaft, the output resistance value of the rotary variable resistor varies; hence, the paper width of the placed paper sheet can be obtained from this resistance value.

According to the above-mentioned structure, it can be actualized to make the size of the resistor small. Further, because the motion of the second paper regulating member is transmitted to the shaft of the rotary variable resistor through the rack for detecting paper width and the gear for detecting paper width, no slippage occurs in the path of motion transmission, resulting in the high accuracy of detecting the position of the paper regulating member which makes the accuracy of detecting paper width also high.

2. A paper width detecting device wherein the aforesaid second rack of the second rack member is used also as the rack for detecting paper width, and the pinion for transmitting motion is also used as the gear for detecting paper width, and further, the shaft of the rotary variable resistor is joined to the pinion for transmitting motion coaxially in a manner such that the relative rotational displacement is regulated.

According to this invention, the accuracy of detecting paper width can be made high just as the invention set forth in the paragraph 1. Moreover, it can reduce the number of parts.

3. A paper width detecting device wherein a pillar-shaped portion for fitting is formed at the end of the shaft of the rotary variable resistor, and a cylindrical hole for fitting in which said portion for fitting is to be fitted is formed at the central portion of the gear for detecting paper width, so that the relative positioning between the shaft of the rotary variable resistor and the gear for detecting paper width may be carried out by the fitting of said pillar-shaped portion for fitting and said cylindrical hole for fitting.

According to this invention, when the rotary variable resistor is mounted to the manual paper-feeding tray, first, the terminals of the rotary variable resistor are soldered to the printed board, then, the positioning of the printed board is carried out by fitting the pillar-shaped portion for fitting on the shaft of the rotary variable resistor into the cylindrical hole for fitting of the gear for detecting paper width, and, with this state maintained, the printed board is fixed on the base plate of the manual paper feeding tray. Therefore, at the time of fixing of the printed board, no load is given to the shaft of the rotary variable resistor and the terminals of the rotary variable resistor are never deformed or damaged.

4. A paper width detecting device wherein a T-shaped concave portion is formed at the end surface of the aforesaid pillar-shaped portion for fitting of the rotary variable resistor, and a convex portion having a T-shaped cross section to be fitted into said T-shaped convex portion is formed in the cylindrical hole for fitting of the gear for detecting paper width, so that the relative rotational displacement between the shaft of the rotary variable resistor and the gear for detecting paper width may be regulated.

According to this invention, the rotary variable resistor can be mounted to the manual paper feeding tray in the same manner as the invention set forth in the paragraph 3. Further, in addition to it, the gear for detecting paper width and the shaft of the rotary variable resistor is simply joined together, with the rotational displacement regulated.

5. A paper width detecting device wherein it is memorized as a basic value the output resistance value of the rotary variable resistor in the case where a paper sheet having an intermediate size between the smallest size and the largest size among the plural sizes of the papers to be placed on the manual paper-feeding tray is placed on the manual paper feeding tray, so that the paper width of the paper sheet placed on the manual paper feeding tray may be detected by comparing the output resistance value of the rotary variable resistor with said basic value.

The actual rotary variable resistors have dispersion in the sensitivity, that is, the variation of the resistance value against the rotational angle of its shaft. For this reason, if the output resistance value for the smallest size of the paper placed on the tray is made as the basic value, the dispersion of the output resistance value for the largest size of the paper placed on the tray is made large.

Regarding this, in this invention, because the output resistance value of the rotary resistor in the case where the paper of the intermediate size between the smallest size and the largest size is placed on the manual paper feeding tray is made as the basic value, the dispersion of the output resistance value for the largest size of the paper placed on the tray is reduced to a half in comparison with the case where the output resistance value for the smallest size of the paper placed on the tray is made as the basic value. At the same time, the dispersion of the output resistance value for the intermediate sizes becomes little and the dispersion of the output resistance value for the smallest size increases within a range of no problem.

DETAILED DESCRIPTION OF THE PREFERRED EMBODIMENT

Figure 1:
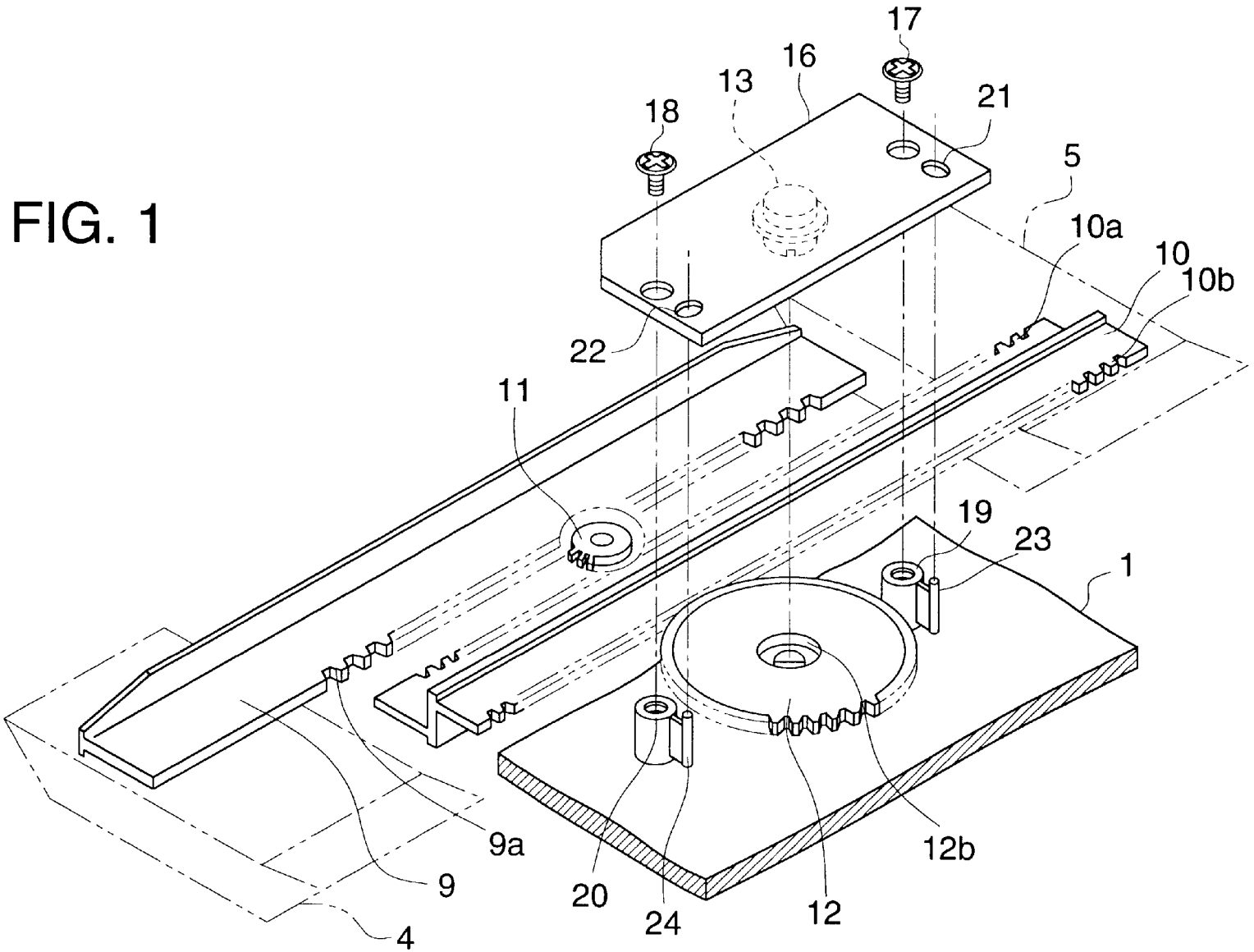
FIG. 1 is an exploded perspective view of the principal portion of an example of the embodiment of this invention seen from the bottom side.
Figure 2:
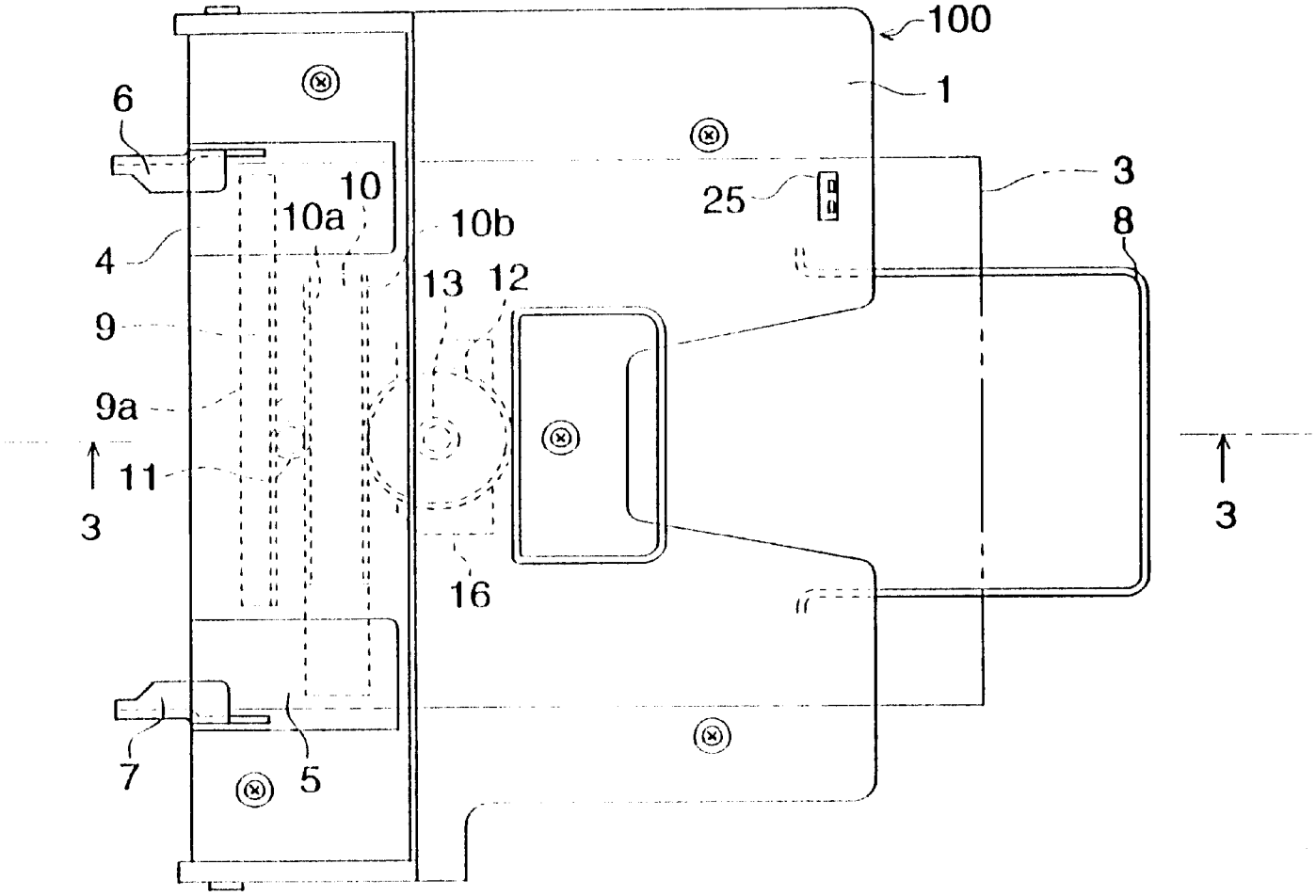
FIG. 2 is the plan of the example of the embodiment shown in FIG. 1, with the toner image fixed by heat and pressure.
Figure 3:
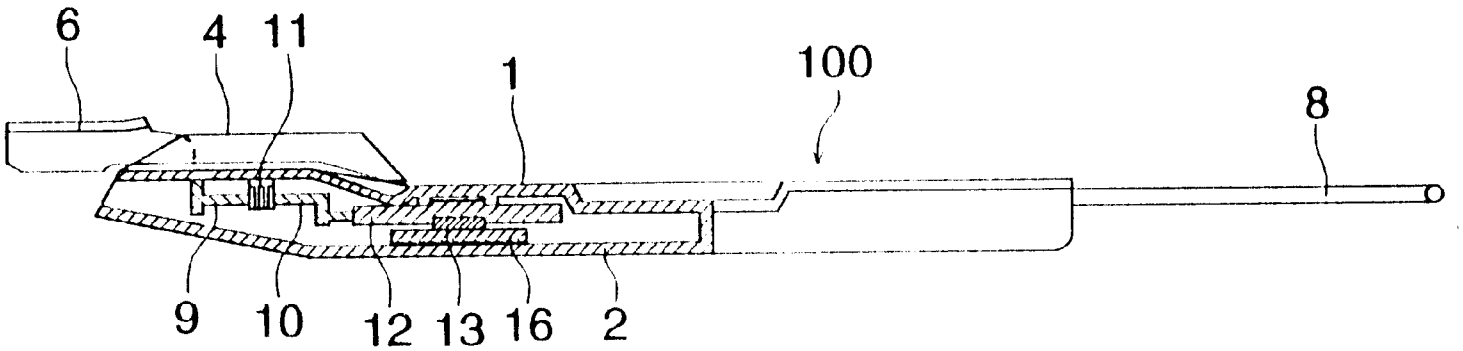
FIG. 3 is the cross-sectional view of the outline at 3—3 section in FIG. 2.

FIG. 1 is an exploded perspective view of the principal portion of an example of the embodiment of this invention seen from the bottom side; FIG. 2 is the plan of the example of the embodiment shown in FIG. 1; and FIG. 3 is the cross-sectional view of the outline at 3—3 section in FIG. 2. First, in FIG. 1 through FIG. 3, 100 is the manual paper feeding tray having the top plate 1 and the bottom plate 2, and the paper sheet 3 is placed on the surface of the top plate 1. The first and second paper regulating members 4 and 5 are mounted to the top plate 1, and are capable of sliding in the paper width direction. Both of them engage with the paper sheet placed on the top plate 1 in such a manner as to put the paper sheet in between from both side in the paper width direction to regulate the movement of the placed paper sheet 3 in the paper width direction.

In this example of the embodiment, the auxiliary regulating plates 6 and 7 are attached to both of the paper regulating members 4 and 5 respectively in order to regulate also the upward movement of the leading edge portion of the placed paper sheet 3. Further, between the top plate 1 and the bottom plate 2, there is provided the U-shaped paper supporting bar 8. This paper supporting bar 8 is adjustable regarding the length of its drawn-out portion.

Further, to the first and second paper regulating members 4 and 5, the first and second rack members 9 and 10, which are made to move as a united member with these paper regulating members 4 and 5 respectively, are fixed. These first and second rack members 9 and 10 are disposed in the space between the top plate 1 and the bottom plate 2, and on both of them the first and second rack 9*a* and 10*a* are formed respectively in the paper width direction. These first rack 9*a* and the second rack 10*a* face each other with a certain spacing in between. Moreover, on the other edge portion of the second rack member 10, the rack for detecting paper width 10*b* is formed in the paper width direction.

Figure 4:
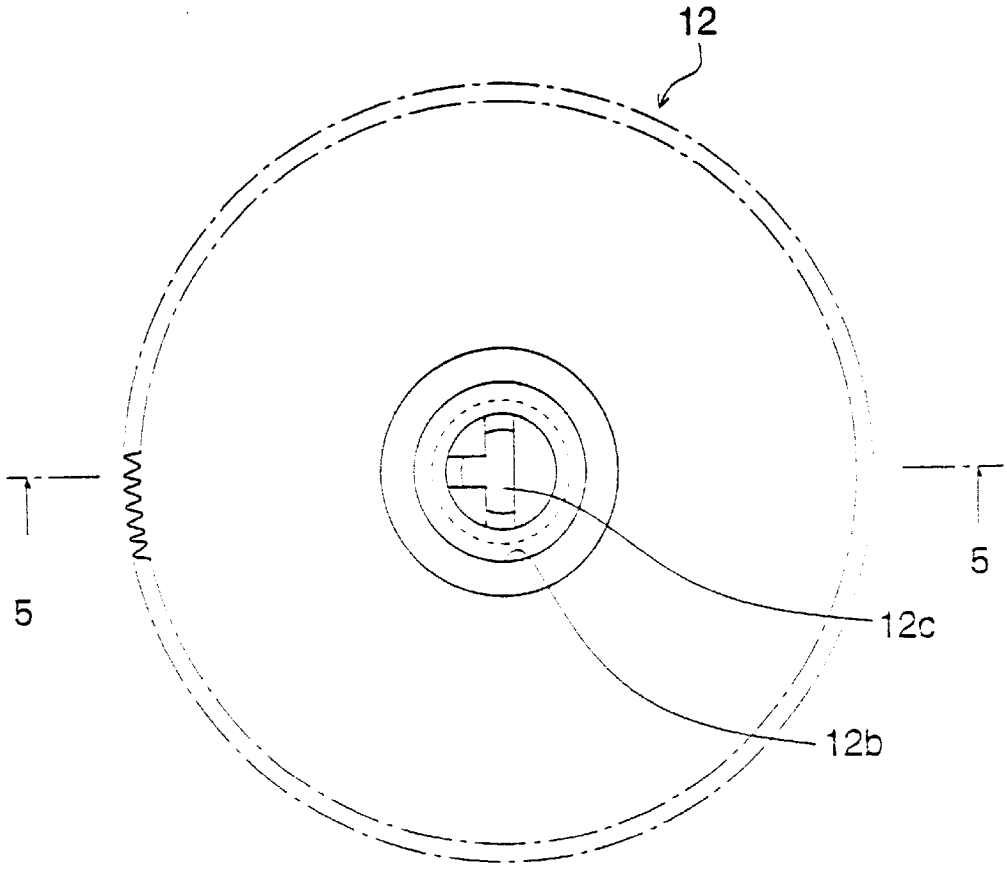
FIG. 4 is the bottom view of the gear for detecting paper width.
Figure 5:
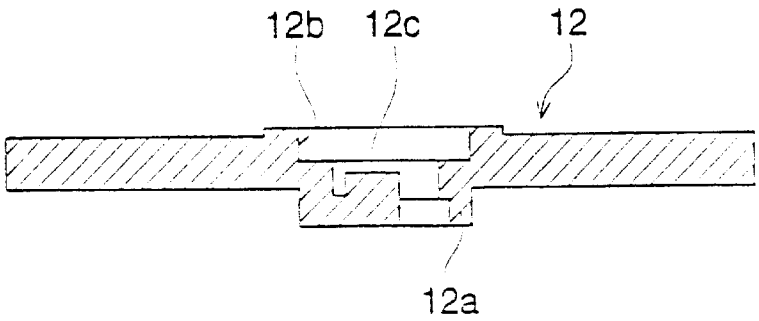
FIG. 5 is the cross-sectional view at 5—5 section in FIG. 4.

The pinion for transmitting motion 11, which is disposed between the rack members 9 and 10, engage with the first and second racks 9*a* and 10*a*, and are supported to be able to rotate on an axis not shown in the drawing. As shown in FIG. 4 and FIG. 5, the gear for detecting paper width 12 has at its central portion the pillar-shaped projection 12*a* protruding to the top plate 1 side, and by fitting this pillar-shaped projection 12*a* into the cylindrical concave portion (not shown in the drawing) provided on the top plate 1, the gear for detecting paper width 12 is supported to be able to rotate. Further, at the central portion on the other side of the gear for detecting paper width 12, the cylindrical hole for fitting 12*b* is formed, and at the bottom of this cylindrical hole 12*b*, the T-shaped convex portion 12*c* is formed.

In addition, in this example of the embodiment, the module of the rack 9*a* and 10*a* is 0.8 and the module of the rack portion for detecting paper width 10*b* is 0.5. If the module is made larger, the tooth form becomes larger; hence, the value around the above-mentioned is optimum. Further, it is desirable to make the ratio of the module of the rack 9*a* and 10*a* to that of the rack for detecting paper width 10*b* a value in the range of 1:0.75 through 1:0.4 in view of making the backlash small and the accuracy of detection high.

Figure 6:
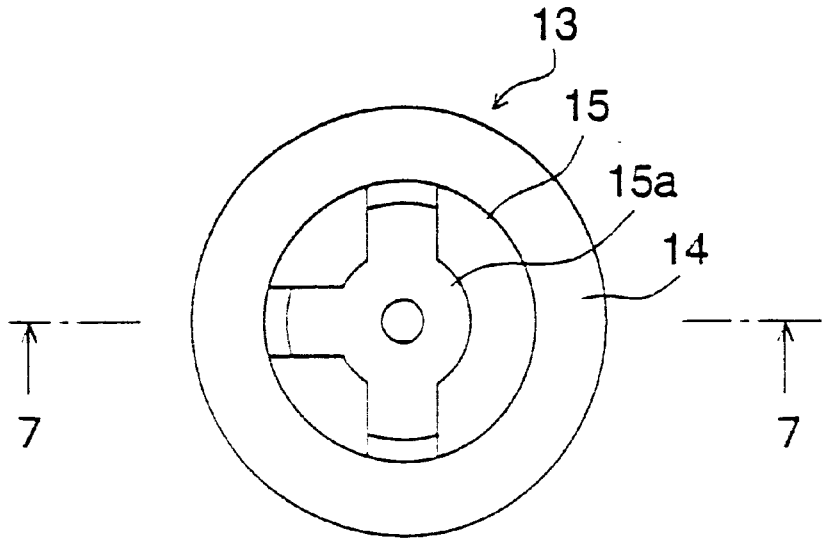
FIG. 6 is the plan of the rotary variable resistor.
Figure 7:
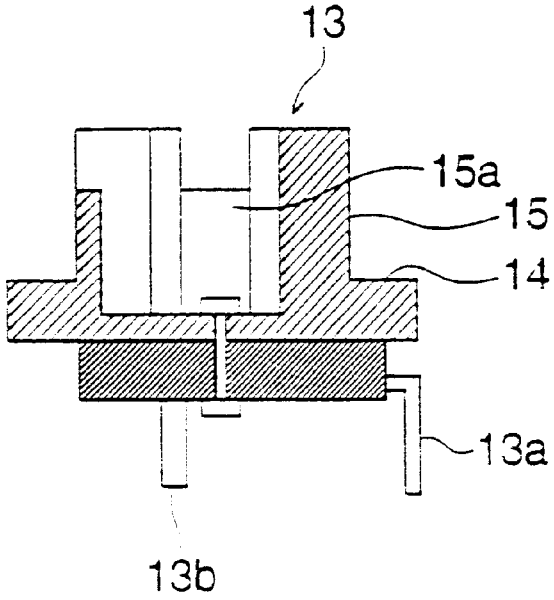
FIG. 7 is the cross-sectional view at 7—7 section in FIG. 6.

The rotary variable resistor 13, which has resistance value in accordance with the angle of rotation of its shaft, is joined with its shaft to the gear for detecting paper width 12 coaxially in a manner such that the relative rotational displacement is regulated. To state it concretely, as shown in FIG. 6 and FIG. 7, at the end portion of the shaft 14 of the rotary variable resistor 13, the pillar-shaped portion for fitting 15, which fits into the cylindrical hole for fitting 12*b* on the gear for detecting paper width 12, is formed, and on the end surface of this pillar-shaped portion for fitting 15, it is formed the concave portion 15*a* having T-shaped cross section, into which the T-shaped convex portion 12*c* of the gear for detecting paper width fits.

The relative positioning of the shaft 14 of the rotary variable resistor 13 and the gear for detecting paper width 12 (positioning on a plane) is carried out by the above-mentioned fitting of the pillar-shaped portion for fitting 15 and the cylindrical hole for fitting 12*b*. Further, by the fitting of the T-shaped convex portion 15*a* and the T-shaped concave portion 12*c*, the relative rotational displacement of the shaft 14 of the rotary variable resistor 13 and the gear for detecting paper width 12 is regulated.

Figure 8:
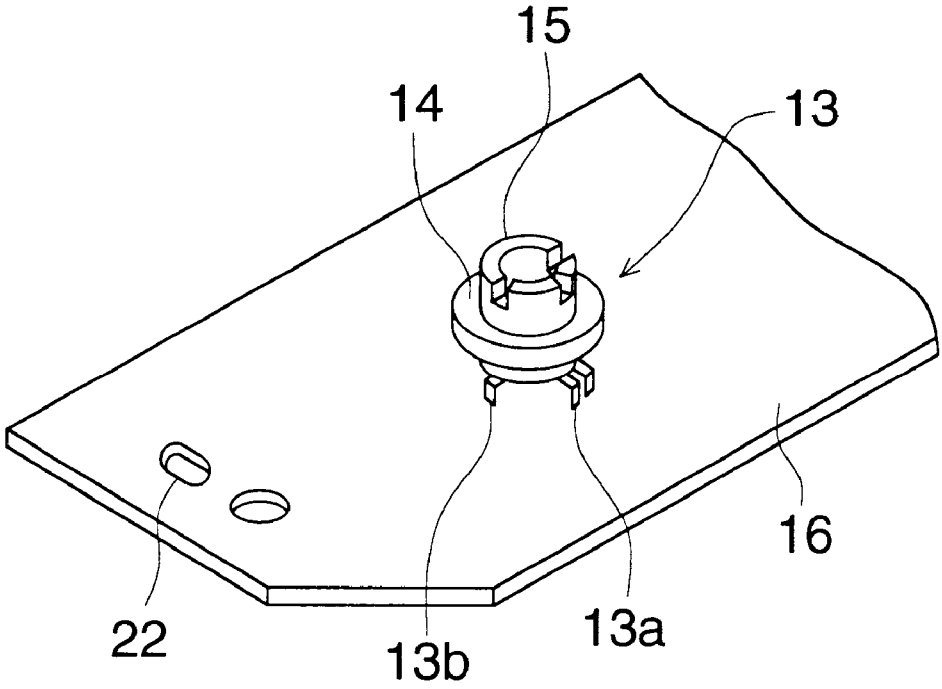
FIG. 8 is a perspective view showing how the rotary variable resistor is mounted to the print board.

In this example of the embodiment, mounting the rotary variable resistor 13 to the manual paper feeding tray (top plate 1) is made as follows. First, the terminals 13*a* and 13*b* of the rotary variable resistor 13 are soldered to the printed board 16 (the state shown in FIG. 8), then, by fitting the pillar-shaped portion for fitting 15 on the shaft 14 of the rotary variable resistor 13 into the cylindrical hole for fitting 12*b* of the gear for detecting paper width 12, the positioning of the printed board 16 is made, and further, with this state maintained, the printed board 16 is fixed to the base plate, that is, the top plate 1 of the manual paper feeding tray with the screws 17 and 18. For this reason, on the supporting posts 19 and 20 of the top plate 1, screw holes for screwing the screws 17 and 18 in are provided.

In addition, the oblong circular holes 21 and 22 in the printed board 16 are the holes in which the guide pins 23 and 24 are fitted loosely for mounting the printed board 16. These oblong circular holes 21 and 22 are not concerned in the positioning of the printed board 16 at all, and the positioning of the printed board 16 is strictly made by fitting of the pillar-shaped portion for fitting 15 of the shaft 14 of the rotary variable resistor 13 and the cylindrical hole for fitting 12*b* of the gear for detecting paper width 12. Accordingly, the oblong circular holes 21 and 22 are not necessarily required.

The reflection type sensor 25 shown in FIG. 2 is fixed to the top plate 1, and is the one for detecting whether a paper is present or not at a predetermined position in the rear edge side. The detection of paper width, as is described in the foregoing, is carried out by detecting the width and the length of the placed paper sheet, and recognition of the length of the placed paper sheet is made by the detection result of this reflection type sensor 25.

In the following, the operation of this example of the embodiment will be explained. First, the paper 3 is placed on the top plate 1 of the manual paper feeding tray, and by making the paper regulating members 4 and 5 be in contact with it sidewise in the paper width direction together with the auxiliary regulating plate 6 and 7, the rack members 9 and 10 move as a united member. At this time, because the racks 9*a* and 10*a* both engage with the pinion 11, the paper regulating members 4 and 5 move to the same distance in the reverse direction to each other. Owing to this, the central position of the placed paper sheet 3 in the paper width direction is always constant regardless of paper size.

When the second rack member 10 moves along with the above-mentioned adjustment of the paper regulating members 4 and 5, the gear for detecting paper width 12, which meshes with the rack for detecting paper width 10*b*, rotates to rotate the shaft 14 of the rotary variable resistor 13. Then, in accordance with the angle of rotation of this shaft 14, the output resistance value of the rotary variable resistor 13 varies, hence, by detecting this output resistance value converted into voltage or else, the paper width of the placed paper sheet 3 can be obtained.

Figure 9:
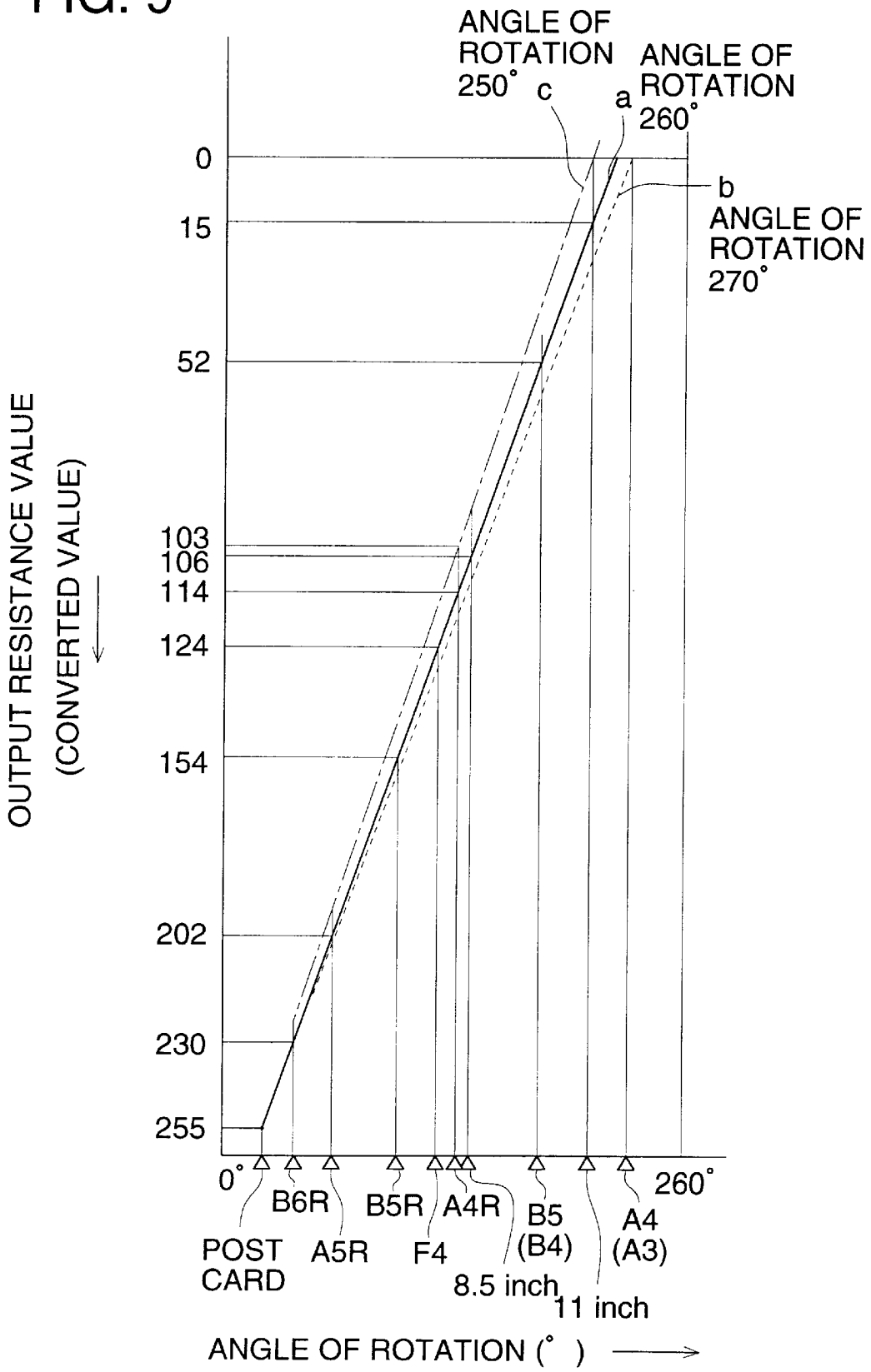
FIG. 9 is a drawing showing an example of variation of the output resistance value against paper width.

Regarding the rotary variable resistor 13, the angle of rotation varies in accordance with paper width and its output resistance value also varies. FIG. 9 is a drawing showing an example of the variation of the resistance value (converted value) against paper width. In FIG. 9, the abscissa is the angle of rotation of the shaft, however in this figure, the size of the paper having the width corresponding to it is noted on the abscissa. The ordinate is the converted value of the output resistance value. The characteristic lines a through c in FIG. 9 show the dispersion of the characteristics.

In the figure, the characteristic line a shows the case where a rotary variable resistor having the range of 260° for the angle of rotation to be detected is employed, and the characteristic lines b and c show the cases where rotary variable resistors having the ranges of 260°±10°, that is, the ranges of 270° and 250° for the angle of rotation to be detected are employed respectively. The Table 1 noted in the following is a table wherein the relationship among every paper size, the angle of rotation, and the output resistance value is shown.

TABLE 1

| | PAPE SIZE in mm | ANGLE OF ROTATION | OUTPUT RESISTANCE VALUE |
|---|---|---|---|
| 1 | The smallest | 0 | 255 |
| 2 | 102 (post card) | 15 | 255 |
| 3 | 128 (B6) | 44 | 230 |
| 4 | 148 (A5) | 66 | 202 |
| 5 | 182 (B5) | 102 | 154 |
| 6 | 203.2 (F4) | 125 | 124 |
| 7 | 210 (A4) | 133 | 114 |
| 8 | 215.9 (8.5 inch) | 140 | 106 |
| 9 | 257 (B5T, B4) | 184 | 52 |
| 10 | 279.4 (11 inch) | 206 | 15 |
| 11 | 297 (A4T, A3) | 226 | 0 |
| 12 | The largest | 260 | 0 |

Remark: B5T and A4T in the above table mean B5 placed transversely and A4 placed transversely respectively.

In the above-mentioned FIG. 9 and Table 1, the measured values the case where the adjustment is carried out with the output resistance value for the smallest size paper (post card) on the tray made the basic value (zero point). However in this case, when the dispersion of the rotary variable resistor is large, the shift of the output resistance value for the largest size paper (A4T, A3) placed on the tray (in the example of FIG. 9, the difference between the characteristic lines a and c) becomes large. That is, the dispersion of the output resistance value becomes large. Accordingly, if a rotary variable resistor having an output characteristics which is much different to the others, there of being unable to detect paper width precisely.

Figure 10:
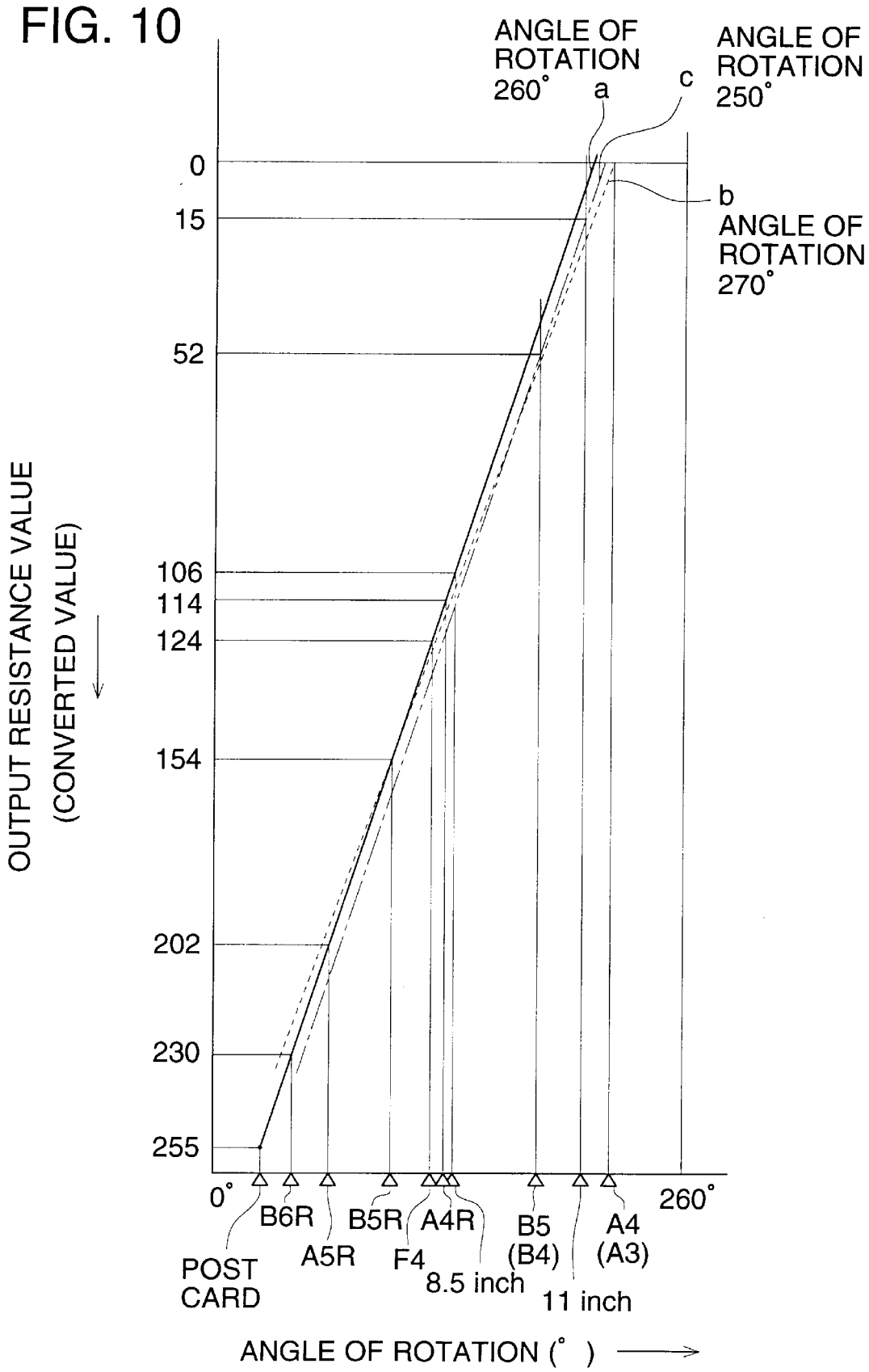
FIG. 10 is a drawing showing another example of variation of the output resistance value against paper width.

This problem can be avoided by making an adjustment such that the output resistance value of the rotary variable resistor when the paper having an intermediate size between the smallest size and the largest size (for example, A4 placed longitudinally) is placed on the manual paper feeding tray is made the basic value (zero point). With this adjustment made, the dispersion of the output resistance value in the case where the largest size paper is placed on the tray is reduced to a half in comparison with the case where the output resistance value for the smallest size paper on the tray is made the basic value, as shown in FIG. 10. At the same time, the dispersion of the output resistance value in the intermediate size part is almost zero. This also makes it higher the accuracy of detection in the part of the intermediate size where paper width values in the paper size dimensions are relatively concentrated, which is favorable. In addition, the dispersion of the output resistance value in the part of the smallest size is made larger although it is within the range of no problem.

Table 2 noted in the following is a table wherein the relationship among the every paper size, the angle of rotation, and the output resistance value for the characteristic line a in FIG. 10 is shown.

TABLE 2

| | PAPE SIZE in mm | ANGLE OF ROTATION | OUTPUT RESISTANCE VALUE |
|---|---|---|---|
| 1 | The smallest | 0 | 141 |
| 2 | 102 (post card) | 15 | 141 |
| 3 | 128 (B6) | 44 | 116 |
| 4 | 148 (A5) | 66 | 88 |
| 5 | 182 (B5) | 102 | 40 |
| 6 | 203.2 (F4) | 125 | 10 |
| 7 | 210 (A4) | 133 | 0 |
| 8 | 215.9 (8.5 inch) | 140 | −8 |
| 9 | 257 (B5T, B4) | 184 | −62 |
| 10 | 279.4 (11 inch) | 206 | −99 |
| 11 | 297 (A4T, A3) | 226 | −114 |
| 12 | The largest | 260 | −114 |

As is mentioned above, the detection of the paper width of the paper sheet placed on the tray can be done by using the output resistance value of the rotary variable resistor 13 only However, from the rotary variable resistor, it can be detected that the paper width is, for example, of A-size, but the detection can not be made to the extent that the paper size is, for example, A4. That is, it can not be detected whether the paper is of A3 size placed longitudinally or it is of A4 size placed transversely. For this reason, in this example of the embodiment, the length of the paper sheet placed on the tray is recognized by detecting whether the paper sheet 3 is present or not at the predetermined position in the rear edge side with the reflection type sensor 25, and the detection of paper size is carried out through combining the output resistance value of the rotary variable resistor 13 and the result of the detection of this reflection type sensor 25.

According to the above-mentioned structure, it can be actualized to make the resistor small-sized. Moreover, no slippage occurs in the path of motion transmission because the motion of the second paper regulating member 5 is transmitted to the shaft 14 through the rack for detecting paper width 10*b* and the gear for detecting paper width 12. Therefore, the accuracy of detecting the position of the paper regulating member 5 is high and the accuracy of the paper width detection is also high.

Further, according to the above-mentioned structure, the pillar-shaped portion for fitting 15 is formed at the end of the shaft 14 of the rotary variable resistor 13, and the cylindrical hole for fitting 12*b*, in which above-mentioned pillar-shaped portion for fitting 15 is to be fitted, is formed at the central portion of the gear for detecting paper width 12, so that the relative positioning of the shaft 14 of the rotary variable resistor 13 and the gear for detecting paper width 12 may be made by fitting the pillar-shaped portion for fitting 15 into the cylindrical hole for fitting 12*b*. Further, at the time of mounting the rotary variable resistor 13 to the top plate 1 of the manual paper-feeding tray, first, the terminals 13*a* and 13*b* of the rotary variable resistor 13 are soldered to the printed board 16, then the positioning of the printed board 16 is carried out by fitting the pillar-shaped portion for fitting 15 on the shaft 14 of the rotary variable resistor 13 into the cylindrical hole for fitting 12*b* of the gear for detecting paper width 12, and with this state maintained, the printed board 16 is fixed to the top plate 1 of the manual paper feeding tray.

Therefore, at the time of fixing the printed board, no load is given to the shaft 14 of the rotary variable resistor 13, and the terminals 13*a* and 13*b* of the rotary variable resistor 13 are never deformed or damaged.

Regarding the above-mentioned structure for mounting, it may be considered possible, for example, that the oblong circular hole 21 is altered to a circular hole to make the guide pin 24 fit into this circular hole without clearance, and the narrower width of the oblong circular hole 22 is designed to have no clearance against the guide pin 24, so that the printed board is fixed at a point with the guide pin 23 and is restrained from rotating with the guide pin 24. However, by making the structure like this, the positioning of the printed board 16 is made completely with the guide pins 23 and 24, hence, at the time of mounting the printed board 16 to the top plate 1, if the accuracy in soldering the rotary variable resistor 13 to the printed board 16 is low, the shaft 14 of the rotary variable resistor 13 is subjected to a pressing force in the horizontal direction from the gear for detecting paper width 12, resulting in the deformation or damage of the terminals 13*a* and 13*b* of the rotary variable resistor 13.

Further, because this example of the embodiment has a structure such that the relative rotational displacement between the shaft 14 of the rotary variable resistor 13 and the gear for detecting paper width 12 is regulated by fitting the T-shaped convex portion 12*c* into the T-shaped concave portion 15*a*, the gear for detecting paper width 12 and the shaft 14 of the rotary variable resistor 13 can be joined simply with the rotational displacement regulated.

Figure 12:
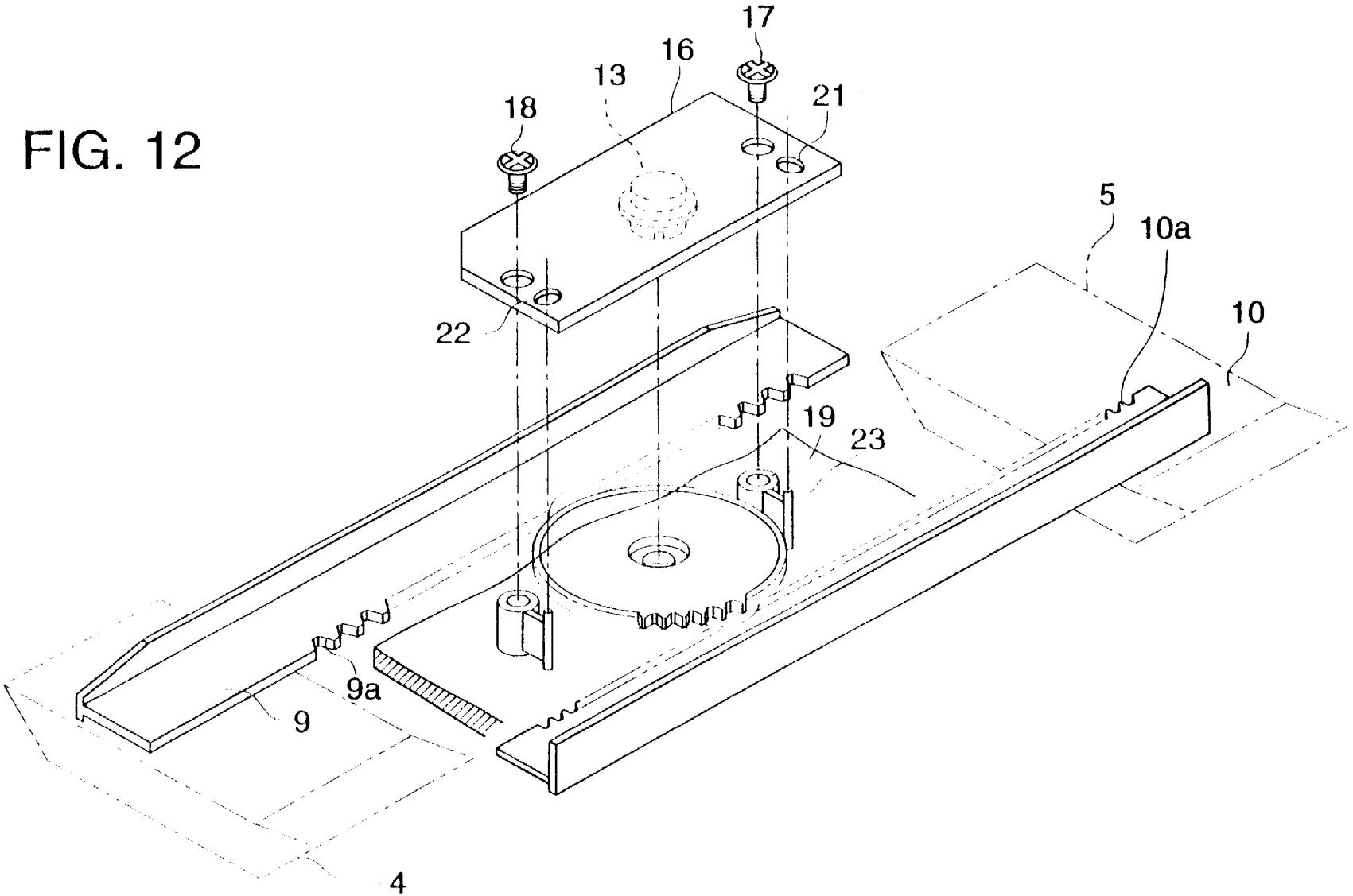
FIG. 12 is an exploded perspective view of the principal portion of another embodiment of the invention.

In addition, as shown in FIG. 12, it is possible that the structure of the above-described example of the embodiment is altered in a manner such that the second rack 10*a* of the second rack member 10 is used also as the rack for detecting paper width 10*b*, the pinion for transmitting motion 11 is also used as the gear for detecting paper width 12, and the shaft 14 of the rotary variable resistor 13 is joined to the pinion for transmitting motion 11 coaxially in a manner such that the relative rotational displacement is regulated. By making the structure as this, the number of parts can be reduced.

Figure 11:
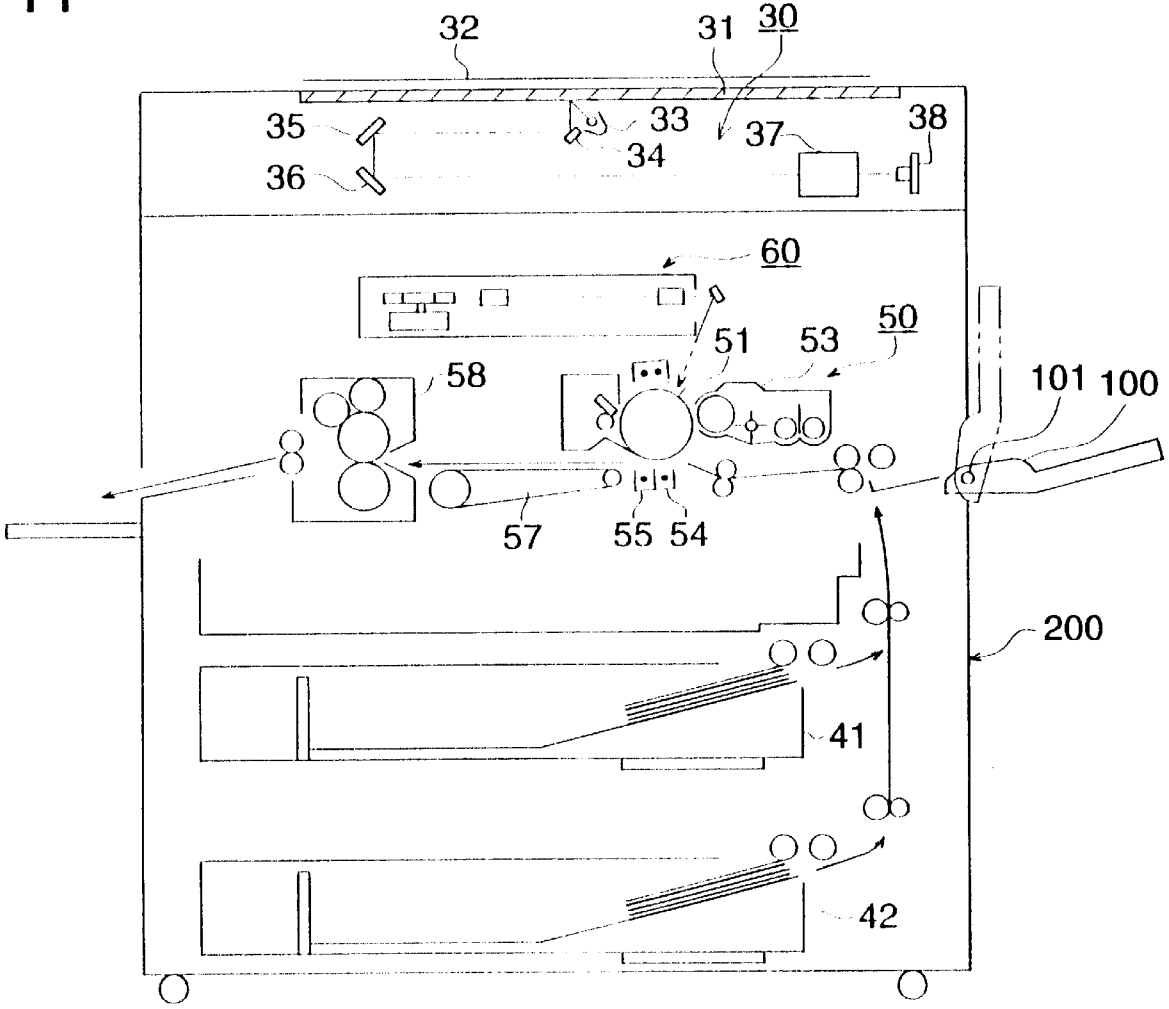
FIG. 11 is a drawing showing an example of mounting the example of the embodiment shown in FIG. 2 to a copying apparatus.

FIG. 11 shows an example of mounting the above-described example of the embodiment to a copying apparatus. In this drawing, the manual paper feeding tray 100 is attached to the apparatus mainframe 200 using the hinge pin 101. The position shown with the double dot and a dash line in FIG. 11 is the one where the manual paper feeding tray is shut up, and when the manual paper feeding tray is used, it is rotated clockwise around the hinge pin 101 to be about in a horizontal position shown with the solid line.

In the following, the operation of this copying apparatus will be explained. First, light is radiated onto the surface of the original document 32 on the glass platen 31 from the light source 33 in the image reading portion 30, and the reflected light reaches to the light receiving surface of the CCD 38, the photoelectric conversion means, where it focuses, through the mirrors 34, 35, and 36, and through the imaging optical system 37. The image data of the original document 32 read by the image reading portion 30 (CCD 38) is sent to the image processing portion for the read image data, which is not shown in the drawing, where the data are memorized in the image memory after being subjected to the specified image processing.

On the other hand, a sheet of transfer paper is conveyed out from the paper feeding cassette 41, or 42, or from the manual paper feeding tray 100, and is fed to the image forming portion 50. The transfer paper sheet heading for the image forming portion 50 is made to be in synchronism with the image forming process by the registration rollers at the entrance of it, then the paper is transported to the photoreceptor drum 51 in the image forming portion 50.

The aforesaid image data read out from the image memory are inputted in the image writing portion 60. In the image writing portion 60, the laser light modulated in accordance with the image data is radiated onto the photoreceptor drum 51 from the laser diode to form a latent electrostatic image. A toner image is formed on the photoreceptor drum 51 by developing this latent electrostatic image in the developing portion 53.

This toner image is transferred to the transfer paper in the transfer portion 54 under the photoreceptor drum 51. After that, the transfer paper sheet being in pressed contact with the photoreceptor drum 51 is picked off at the pick off portion 55, transported into the fixing portion 58 through the transport mechanism 57, and discharged, with the toner image fixed by heat and pressure.

This copying apparatus is provided with the two paper feeding cassettes 41 and 42 in the apparatus mainframe 200, but with these only, it is not able to select out and feed all of the transfer papers of requested size. Therefore, the papers of the remaining sizes which are not set in the paper feeding cassettes 41 and 42 have to be fed from the manual paper feeding tray 100. On that occasion, the control portion in the apparatus mainframe 200 detects of which size transfer paper is set on the manual paper feeding tray from the output resistance value of the above-mentioned rotary variable resistor 13 and the detection result of the reflection type sensor 25 to execute the required paper feeding operation.

In addition, the paper width detecting device for the manual paper feeding tray of this invention is not only used in the above-mentioned copying apparatus, but also can be used in various image forming apparatus such as a printer etc. Further, the paper to be fed by this manual paper feeding tray is not limited to a paper to form an image on it, but in some cases, it is an original document. For example, in the case where an original document is fed by an ADF (automatic document feeder), it may be considered that the original document of the size which the ADF can not feed is fed in by a manual paper feeding tray. The paper width detecting device can be used in such a case.

As has been explained up to now, according to a first aspect of the invention, when a paper is placed on the manual paper feeding tray, and the first and second paper regulating members are made to become in contact with it from both sides in the paper width direction, the first and second racks move as a united member. At this time, because the first and second racks mesh with the same pinion, the first and second paper regulating members move to the same distance in the reverse direction to each other. Accordingly, the central position in the paper width direction of the paper placed on the tray is always constant regardless of paper size.

When the second rack member moves, the gear for detecting paper width engaging with the rack for detecting paper width rotates, and the shaft of the rotary variable resistor also rotates. Thus, the output resistance value of the rotary variable resistor varies in accordance with the angle of rotation of this shaft, hence, the paper width of the paper placed on the tray can be obtained from this output resistance value.

According to the above-mentioned invention, the resistor can be small-sized. Moreover, because the motion of the second paper regulating member is transmitted to the shaft of the rotary variable resistor through the rack for detecting paper width and the gear for detecting paper width, no slippage occurs in the path of motion transmission, the accuracy of detecting the position of the paper regulating member is high, and further, the accuracy of detecting paper width is also high.

According to a second aspect of the invention, because the second rack of the second rack member is used also as the rack for detecting paper width, and the pinion for transmitting motion is used also as the gear for detecting paper width, and further, the shaft of the rotary variable resistor is joined coaxially to the pinion for transmitting motion in a manner such that the relative rotational displacement is regulated, the accuracy of detecting paper width can be made high in the same manner as described with respect to the first aspect of the invention set forth above. In addition the number of parts can be reduced.

According to a third aspect of the invention, because a pillar-shaped portion for fitting is formed at the end of the shaft of the rotary variable resistor, and a cylindrical hole for fitting in which said portion for fitting is fitted is formed, so that the relative positioning between the shaft of the rotary variable resistor and the gear for detecting paper width may be carried out, at the time of mounting the rotary variable resistor to the manual paper feeding tray, first, the terminals of the rotary variable resistor are soldered to the printed board, then the positioning of the printed board is carried out by fitting the pillar-shaped portion for fitting on the shaft of the rotary variable resistor into the cylindrical hole for fitting of the gear for detecting paper width, and further, with this state maintained, the printed board can be fixed to the manual paper feeding tray. Therefore, at the time of fixing the print board, no load is given to the shaft of the rotary variable resistor, and the terminals of the rotary variable resistor are never deformed or damaged.

According to a fourth aspect of the invention, a concave portion having T-shaped cross section is formed on the end surface of the pillar-shaped portion for fitting of the rotary variable resistor, and a convex portion having T-shape cross section, which fits into said T-shaped concave portion, is formed in the cylindrical hole of the gear for detecting paper width, so that the relative rotational displacement between the shaft of the rotary variable resistor and the gear for detecting paper width may be regulated, hence, the rotary variable resistor can be mounted to the manual paper feeding tray in the same manner as described with respect to the third aspect of the invention set forth above. Further, in addition to it, the gear for detecting paper width and the shaft of the rotary variable resistor is simply joined together, with the rotational displacement regulated.

According to a fifth aspect of the invention, because the output resistance value of the rotary variable resistor in the case where the paper of the intermediate size between the smallest size and the largest size is placed on the manual paper feeding tray is made the basic value, the dispersion of the output resistance value for the largest size of the paper placed on the tray is reduced to a half in comparison with the case where the output resistance value for the smallest size of the paper placed on the tray is made the basic value.

What is claimed is:

1. A device for detecting a width of a sheet placed on a manual feeding tray of an image forming apparatus, comprising:

a first and a second sheet regulating member for moving in a sheet width direction so as to come in contact with both sides of the sheet and for holding the sheet therebetween, thereby regulating movement of the sheet in the sheet width direction;

a first rack member on which a first rack is arranged in the sheet width direction, said first rack member moving interlockingly with the first sheet regulating member;

a second rack member on which a second rack and a sheet width-detecting rack are respectively arranged in the sheet width direction, said second rack member moving interlockingly with the second sheet regulating member, and said second rack being positioned so as to face the first rack on the first rack member, wherein a module of the sheet-width detecting rack is 0.4 to 0.75 times a module of the first rack and the second rack;

a pinion engaging with the first rack and the second rack;

a gear engaging with the sheet width-detecting rack;

a rotary variable resistor having a shaft which is coaxially joined to the gear so as to regulate rotational displacement of the rotary variable resistor relative to the gear, said rotary variable resistor being rotated when at least one of the first and the second sheet regulating members is moved so as to hold the sheet therebetween, and said rotary variable resistor having a resistance value which is varied in accordance with a rotation angle thereof; and a detector for detecting the width of the sheet based on the resistance value of the rotary variable resistor.

2. The device of claim 1, further comprising a printed board provided with the rotary variable resistor, and a base plate provided with the gear;

wherein one of the gear and the shaft of the rotary variable resistor is provided with a protrusion and the other one of the gear and the shaft of the rotary variable resistor is provided with a hole, wherein the gear and the shaft of the rotary variable resistor are engaged by fitting the protrusion with the hole, and wherein the printed board is fixed on the base plate so as to maintain engagement between the gear and the shaft of the rotary variable resistor.

3. The device of claim 2, wherein a side wall of one of the hole and the protrusion is provided with a key and a side wall of the other one of the hole and the protrusion is provided with a groove, and wherein a rotational displacement between the hole and the protrusion is regulated by fitting the key with the groove.

4. The device of claim 1, wherein the detector detects the width of the sheet loaded on the manual feeding tray by comparing the resistance value of the rotary variable resistor with each of reference resistance values which represent plural widths including a minimum width, an intermediate width, and a maximum width.

5. The device of claim 1, wherein the reference resistance values are corrected based on a basic value represented by the reference resistance value of the intermediate width.

6. A device for detecting a width of a sheet placed on a manual feeding tray of an image forming apparatus, comprising:

a first and a second sheet regulating member for moving in a sheet width direction so as to come in contact with both sides of the sheet and for holding the sheet therebetween, thereby regulating movement of the sheet in the sheet width direction;

a first rack member on which a first rack is arranged in the sheet width direction, said first rack member moving interlockingly with the first sheet regulating member;

a second rack member on which a second rack is arranged in the sheet width direction, said second rack member moving interlockingly with the second sheet regulating member, and said second rack being positioned so as to face the first rack on the first rack member;

a pinion engaging with the first rack and the second rack;

a rotary variable resistor engaging with the pinion so that the rotary variable resistor is rotated when at least one of the first and the second sheet regulating members is moved so as to hold the sheet therebetween, said rotary variable resistor having a resistance value which is varied in accordance with a rotation angle thereof;

a base plate provided with the pinion;

a printed board provided with the rotary variable resistor; and a detector for detecting the width of the sheet based on the resistance value of the rotary variable resistor, wherein one of the gear and the shaft of the rotary variable resistor is provided with a protrusion and the other one is provided with a hole, wherein the gear and the shaft of the rotary variable resistor are engaged by fitting the protrusion with the hole, and wherein the printed board is fixed on the base plate so as to maintain engagement between the gear and the shaft of the rotary variable resistor.

7. The device of claim 6, wherein said rotary variable resistor has a shaft which is coaxially joined to the pinion so as to regulate rotational displacement of the rotary variable resistor relative to the pinion.

* * * * *